US010870939B2

(12) United States Patent
Hasegawa et al.

(10) Patent No.: US 10,870,939 B2
(45) Date of Patent: Dec. 22, 2020

(54) SEWING MACHINE NEEDLE

(71) Applicants: Organ Needle Co., Ltd., Ueda (JP); Toyota Shatai Kabushiki Kaisha, Kariya (JP)

(72) Inventors: Chie Hasegawa, Ueda (JP); Yuji Ichikawa, Ueda (JP); Mai Mitsuya, Ueda (JP); Kazutaka Hakoyama, Ueda (JP); Kenji Kato, Kariya (JP); Yoshikazu Kohara, Kariya (JP)

(73) Assignees: ORGAN NEEDLE CO., LTD., Ueda (JP); TOYOTA AUTO BODY CO., LTD., Kariya (JP)

( * ) Notice: Subject to any disclaimer, the term of this patent is extended or adjusted under 35 U.S.C. 154(b) by 102 days.

(21) Appl. No.: 16/161,617

(22) Filed: Oct. 16, 2018

(65) Prior Publication Data

US 2019/0112739 A1 Apr. 18, 2019

(30) Foreign Application Priority Data

Oct. 18, 2017 (JP) ..... 2017-201553

(51) Int. Cl.
*D05B 85/02* (2006.01)

(52) U.S. Cl.
CPC ..... *D05B 85/02* (2013.01)

(58) Field of Classification Search
CPC ..... D05B 85/00–14; D05B 85/003; D05B 85/006; B21G 1/00–06
See application file for complete search history.

(56) References Cited

U.S. PATENT DOCUMENTS 1,151,873 A * 8/1915 Graham ..... D05B 85/00 223/103
2,318,235 A * 5/1943 Lapham ..... D05B 85/00 112/80.05
2,441,171 A * 5/1948 Schulz ..... D05B 85/00 112/222
3,999,877 A * 12/1976 Ketterer ..... D05B 1/24 112/227
4,455,858 A * 6/1984 Hettich ..... A41H 37/008 72/324
5,311,889 A * 5/1994 Ringle ..... A61C 15/045 132/321
6,637,356 B2 * 10/2003 Beverly ..... D05C 15/20 112/222

FOREIGN PATENT DOCUMENTS

JP 60-10542 Y2 4/1985
JP 7-63554 B2 7/1995

* cited by examiner

*Primary Examiner* — Ismael Izaguirre
(74) *Attorney, Agent, or Firm* — Westerman, Hattori, Daniels & Adrian, LLP

(57) ABSTRACT

There is provided a sewing machine needle 10 including: a shank portion 11 that is attached to a sewing machine; and a shaft portion 12 that is provided on a front end side of the shank portion 11; wherein: a needle eye 13 is formed to penetrate the shaft portion 12, and a long groove 14 for guiding a thread from a position of the needle eye 13 toward the shank portion 11 is formed in the shaft portion 12; and a suppression portion 16 for suppressing movement of a needle thread 21 is provided in an intermediate portion of the long groove 14. Thus, it is possible to provide a sewing machine needle by which a loop can be formed stably and that causes few damage to a needle thread and can be also manufactured easily.

14 Claims, 24 Drawing Sheets

SEWING MACHINE NEEDLE

BACKGROUND OF THE INVENTION

1. Field of the Invention

The present invention relates to a sewing machine needle used for sewing in a sewing machine.

2. Description of the Background Art

In the background art, a sewing machine needle provided with a long groove for reducing frictional resistance between a needle thread and a piece of cloth has been put to practical use. Assume that such a sewing machine needle is used. In this case, when the sewing machine needle penetrates fabric serving as an object to be sewn, the needle thread that has already been run through a needle eye is guided along the long groove and drawn to a place under the fabric. The needle thread drawn to the place under the fabric forms a loop when the sewing machine needle moves up. The loop is caught by a hook on a back side of the sewing machine needle to thereby form a stitch.

However, when the size or shape of the loop formed by the needle thread is not appropriate, there is a possibility that the loop may not be successfully caught by the hook to thereby lead to occurrence of a problem of stitch skipping etc. When, for example, the loop is too large, the loop may collapse to be thereby unable to be successfully caught by the hook. On the other hand, when the loop is too small, the hook may not go into the loop to thereby fail in catching the needle thread.

In order to solve the aforementioned problem, inventions for setting the width or depth of a long groove in two stages to thereby suppress movement of a needle thread have been disclosed, for example, in JP-Y-60-10542 and JP-B-7-63554. Specifically, the width of the long groove on a shank side is formed narrowly. Thus, movement of the needle thread can be suppressed so that a loop can be formed stably.

However, in the aforementioned configuration disclosed in JP-Y-60-10542 or JP-B-7-63554, the needle thread is retained due to friction that is caused when the needle thread is interposed between the long groove and fabric. The width of the long groove is formed to be narrow or shallow. Accordingly, there is a possibility that the friction caused between the needle thread and the long groove or the fabric may increase over a wide range of the needle thread to thereby increase damage to the needle thread. In addition, large friction is also caused when the needle thread goes into the long groove narrow in width. Accordingly, there is a problem that the wide range of the needle thread may be also damaged on this occasion.

In addition, in the aforementioned configuration disclosed in JP-Y-60-10542 or JP-B-7-63554, the shape of the long groove has to be changed entirely. That is, the machining range is widened. Accordingly, there is a problem that a manufacturing process or quality control may be complicated. For example, there is a problem that the machining may be difficult because the narrow and deep groove has to be cut, or there is a problem that accuracy of a connection portion may be required when the groove is machined in two stages.

SUMMARY OF THE INVENTION

Therefore, an object of the invention is to provide a sewing machine needle by which a loop can be formed stably and that causes less damage to a needle thread and can be also manufactured easily.

The invention has been accomplished in order to solve the aforementioned problems. The invention is characterized as follows.

According to a first configuration of the invention, there is provided a sewing machine needle including: a shank portion that is attached to a sewing machine; and a shaft portion that is provided on a front end side of the shank portion; wherein: a needle eye is formed to penetrate the shaft portion, and a long groove for guiding a thread from a position of the needle eye toward the shank portion is formed in the shaft portion; and a suppression portion for suppressing movement of the thread is provided in an intermediate portion of the long groove.

According to a second configuration of the invention, the suppression portion is formed so that a sectional area of the groove is smaller in the intermediate portion of the long groove, in addition to the aforementioned characteristic of the invention according to the first configuration.

According to a third configuration of the invention, the suppression portion is shaped like a dovetail groove in which width between opening edges is reduced in the long groove, in addition to the aforementioned characteristic of the invention according to the first configuration.

According to a fourth configuration of the invention, the entire suppression portion can move to a place under fabric serving as an object to be sewn when the sewing machine needle is attached to the sewing machine in use, in addition to the aforementioned characteristic of the invention according to any one of the first to third configurations.

According to the invention according to the first configuration as described above, the needle eye is formed to penetrate the shaft portion, and the long groove for guiding the thread from the position of the needle eye toward the shank portion is formed in the shaft portion; and the suppression portion for suppressing movement of the thread is provided in the intermediate portion of the long groove. According to such a configuration, movement of a needle thread is suppressed by the suppression portion. Thus, a loop can be formed stably.

Moreover, the suppression portion is provided locally in the intermediate portion of the long groove. Accordingly, a range in which a load is applied to the needle thread can be narrowed so that damage to the needle thread can be minimized. In addition, the range of the suppression portion is narrow. Accordingly, a range in which friction may be caused when the needle thread goes into the suppression portion is also narrow. As a result, the damage to the needle thread can be minimized.

In addition, the machining range for forming the suppression portion is narrow. Accordingly, the sewing machine needle can be also manufactured easily without the necessity of entirely changing the shape of the long groove.

In addition, according to the second configuration of the invention as described above, the suppression portion is formed so that the sectional area of the groove is smaller in the intermediate portion of the long groove. According to such a configuration, movement of the thread can be suppressed due to contact resistance between an inner surface of the groove and the needle thread.

Moreover, according to the third configuration of the invention as described above, the suppression portion is shaped like the dovetail groove in which the width between the opening edges is reduced in the long groove. According to such a configuration, the needle thread can be prevented from easily coming off the suppression portion. Thus, the needle thread can be surely retained. In addition, the needle thread retained by the suppression portion can be prevented from easily touching the fabric. Thus, friction between the fabric and the needle thread can be prevented from being easily caused. That is, damage received by the needle thread can be suppressed.

In addition, according to the fourth configuration of the invention as described above, the entire suppression portion can move to the place under the fabric serving as the object to be sewn when the sewing machine needle is attached to the sewing machine in use. According to such a configuration, the needle thread can be retained in the vicinity of the needle eye. Accordingly, formation of a loop on the suppression portion side can be suppressed so that the loop can be formed stably on the back side.

In addition, when the sewing machine needle is passing through the fabric, the needle thread is pushed into the suppression portion by the fabric. Accordingly, the needle thread can be surely retained by the suppression portion.

DETAILED DESCRIPTION OF THE INVENTION

Figure 1A:
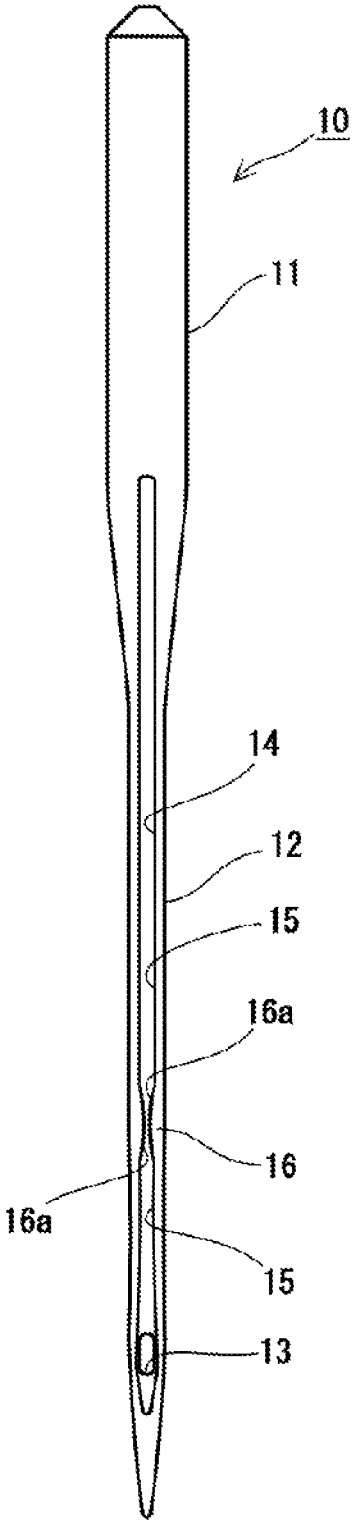
FIGS. 1A and 1B are a front view and a back view of a sewing machine needle.

An embodiment of the invention will be described with reference to the drawings.

A sewing machine needle 10 according to the embodiment is provided with a shank portion 11 and a shaft portion 12. The shank portion 11 is attached to a sewing machine. The shaft portion 12 is provided on a front end side of the shank portion 11.

The shaft portion 12 is a part that can penetrate fabric 20 serving as an object to be sewn. A front end of the shaft portion 12 has a pointed shape to forma needle point. A needle eye 13 through which a needle thread 21 can be run is formed to penetrate the vicinity of the shaft portion 12.

As shown in FIG. 1A, a long groove 14 for guiding the needle thread 21 from the position of the needle eye 13 toward the shank portion 11 is formed on a front side of the shaft portion 12.

Figure 1B:
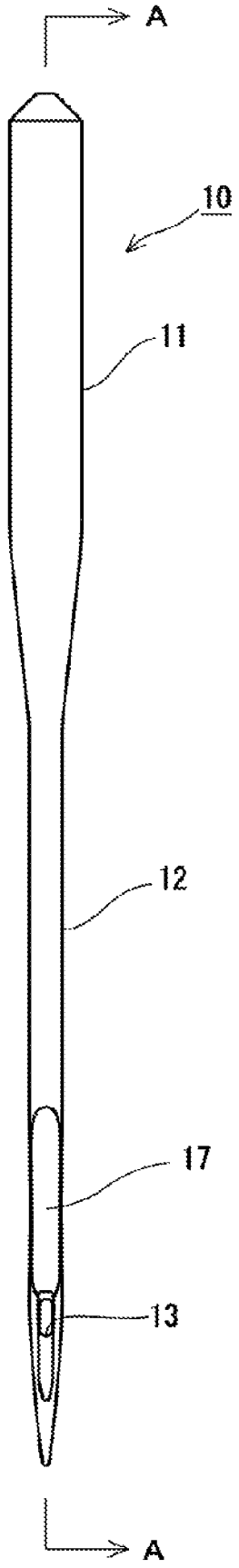

In addition, as shown in FIG. 1B, a scarf portion 17 is formed on a back side of the shaft portion 12 to extend from the position of the needle eye 13 toward the shank portion 11. The scarf portion 17 is provided with a front surface formed flatly. The front surface of the scarf portion 17 forms a surface perpendicular to a penetration direction of the needle eye 13. The maximum width of the scarf portion 17 according to the embodiment is larger than the maximum width of the long groove 14 and substantially the same as the width of the shaft portion 12.

The aforementioned long groove 14 is provided with parallel portions 15 and a suppression portion 16.

Figure 2A:
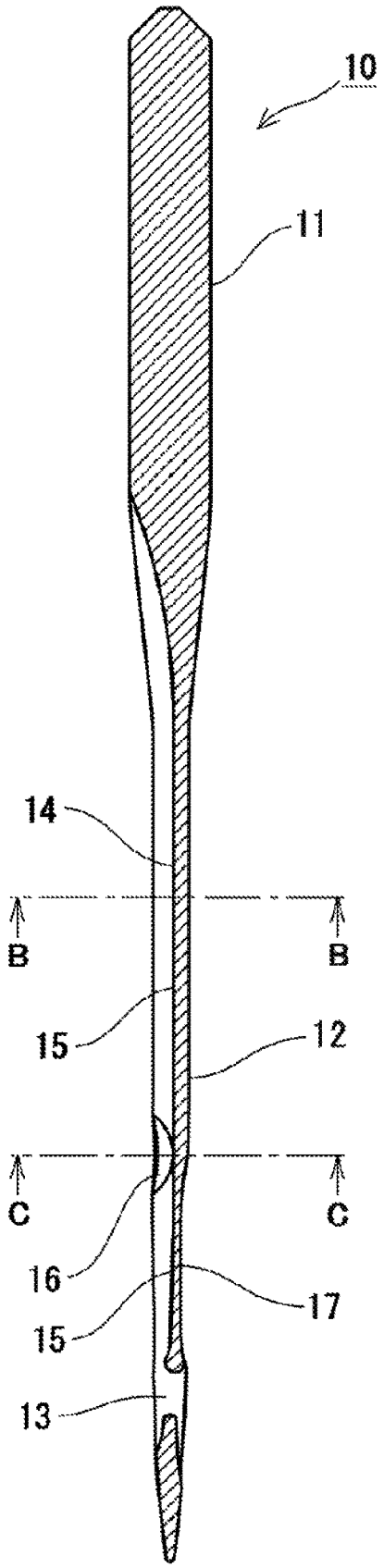
FIGS. 2A, 2B and 2C are sectional views taken along a line A-A, a line B-B and a line C-C of the sewing machine needle respectively.
Figure 2B:
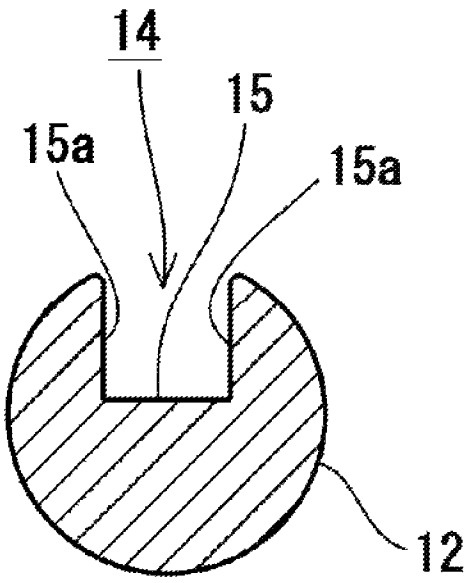

As shown in FIG. 2B, each of the parallel portions 15 is a groove formed into a U-shape in section. The parallel portion 15 has side surfaces 15*a* that are formed in parallel with each other. The parallel portion 15 is formed linearly with the same depth and the same width along a longitudinal direction of the sewing machine needle 10.

The suppression portion 16 is provided locally in an intermediate portion of the long groove 14. The suppression portion 16 serves for suppressing movement of the needle thread 21. The suppression portion 16 is formed in such a manner that a sectional area of the groove in the suppression portion 16 is smaller than that in the parallel portion 15. Thus, movement of the thread can be suppressed due to contact resistance between an inner surface of the groove in the suppression portion 16 and the needle thread 21.

Figure 2C:
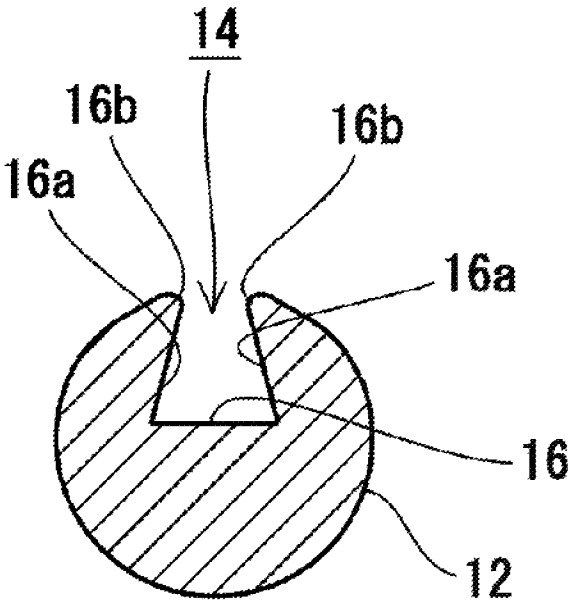

As shown in FIG. 2C, the width of the bottom of the groove in the suppression portion 16 according to the embodiment is the same as that in the parallel portion 15 but opposite side surfaces 16*a* of the suppression portion 16 slant so as to be gradually closer to each other as going toward opening edges 16*b* respectively. Therefore, the suppression portion 16 is shaped like a dovetail groove in which the width between the opening edges 16*b* is reduced in the long groove 14. Due to this shape, the needle thread 21 that has gone into the suppression portion 16 can be surely retained.

In addition, the suppression portion 16 according to the embodiment is formed in such a manner that the opening edges 16*b* are gradually closer to each other as going toward the center of the suppression portion 16 when the suppression portion 16 is viewed in the longitudinal direction of the sewing machine needle 10, as shown in FIG. 1A. In other words, the suppression portion 16 is formed in such a manner that the opening is narrowest at the center of the suppression portion 16. More specifically, the opposite opening edges 16*b* form convex surfaces opposite to each other. Due to this shape, the needle thread 21 can be pushed into the suppression portion 16 without applying any load to the needle thread 21 if possible, and the needle thread 21 that has been pushed into the suppression portion 16 can be surely retained.

The long groove 14 is formed by the aforementioned parallel portions 15 and the aforementioned suppression portion 16. The parallel portions 15 are provided on opposite sides with interposition of the suppression portion 16 therebetween. Incidentally, of the long groove 14, a range in which the suppression portion 16 is provided is a very narrow range. The range where the suppression portion 16 is provided is not larger than ⅕ as long as the entire long groove 14, more preferably not larger than 1/10 as long as the entire long groove 14.

When the suppression portion 16 is formed into such a shape, movement of the needle thread 21 can be suppressed by the suppression portion 16 so that a loop 22 can be formed stably by the needle thread 21.

Figure 9A:
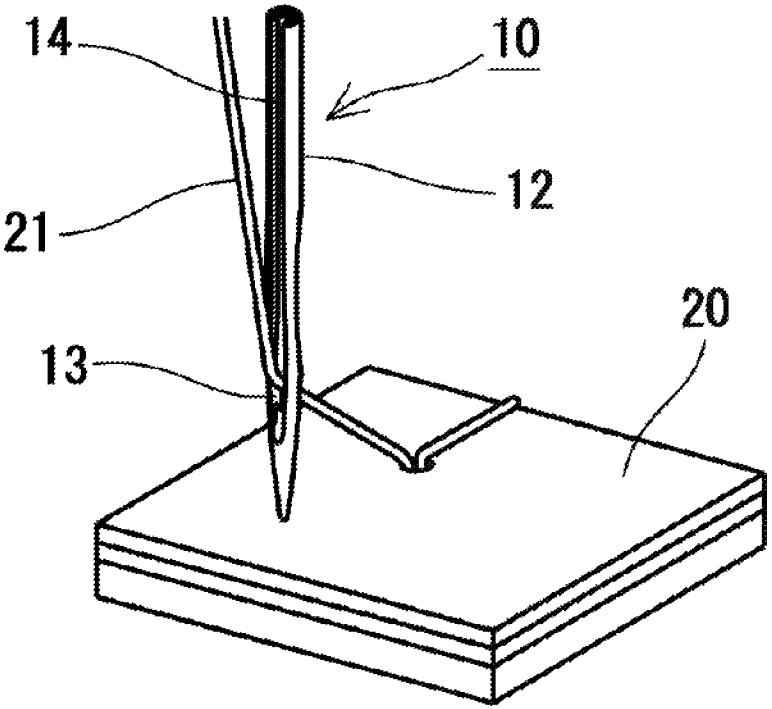
FIGS. 9A to 9C are views for explaining states when a sewing machine needle according to the background art is attached to a sewing machine in use, FIG. 9A being a view in which the sewing machine needle is positioned on an upper surface of fabric, FIG. 9B being a view in which the sewing machine needle is positioned at a bottom dead center, FIG. 9C being a view of a state in which a loop of a needle thread is too large and collapses so that the loop cannot be caught by a hook.
Figure 9B:
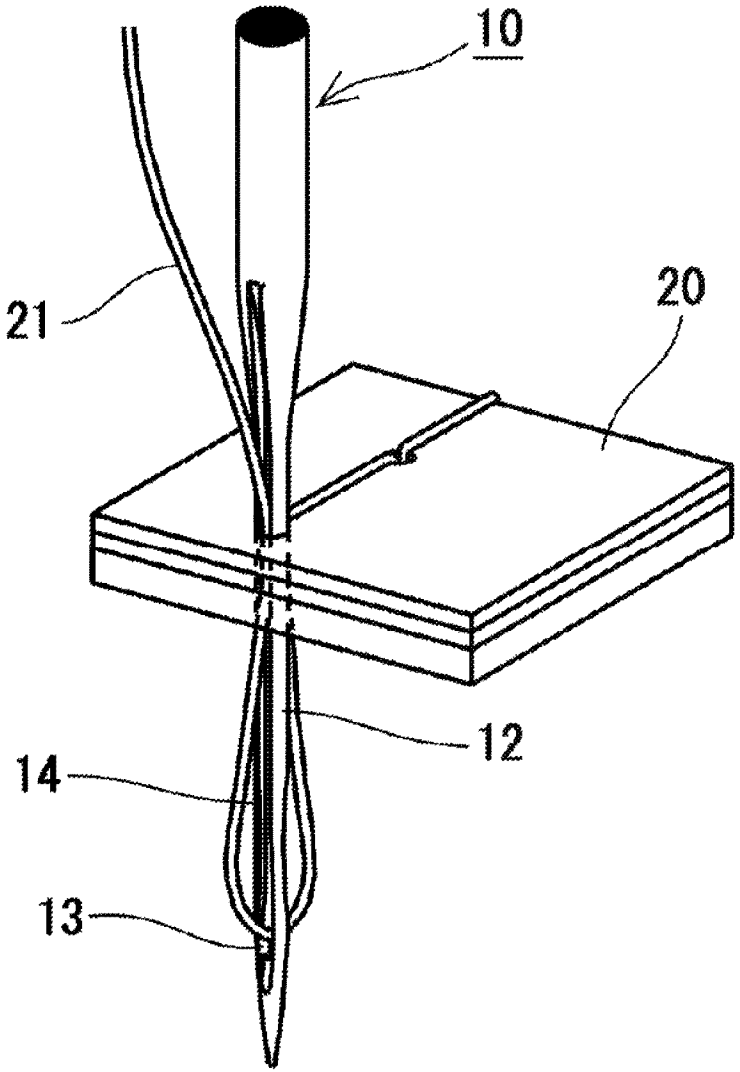

That is, in a sewing machine needle 10 according to the background art, a needle thread 21 that has been run through a needle eye 13 is laid along a long groove 14 to be opposed thereto, as shown in FIG. 9A. When the sewing machine needle 10 penetrates fabric 20 serving as an object to be sewn in this state, the needle thread 21 is drawn along the long groove 14 to reach a place under the fabric 20, as shown in FIG. 9B. When the sewing machine 10 then moves up from a bottom dead center, a loop 22 of the needle thread 21 is formed. Accordingly, a hook 25 tries to catch the loop 22.

Figure 9C:
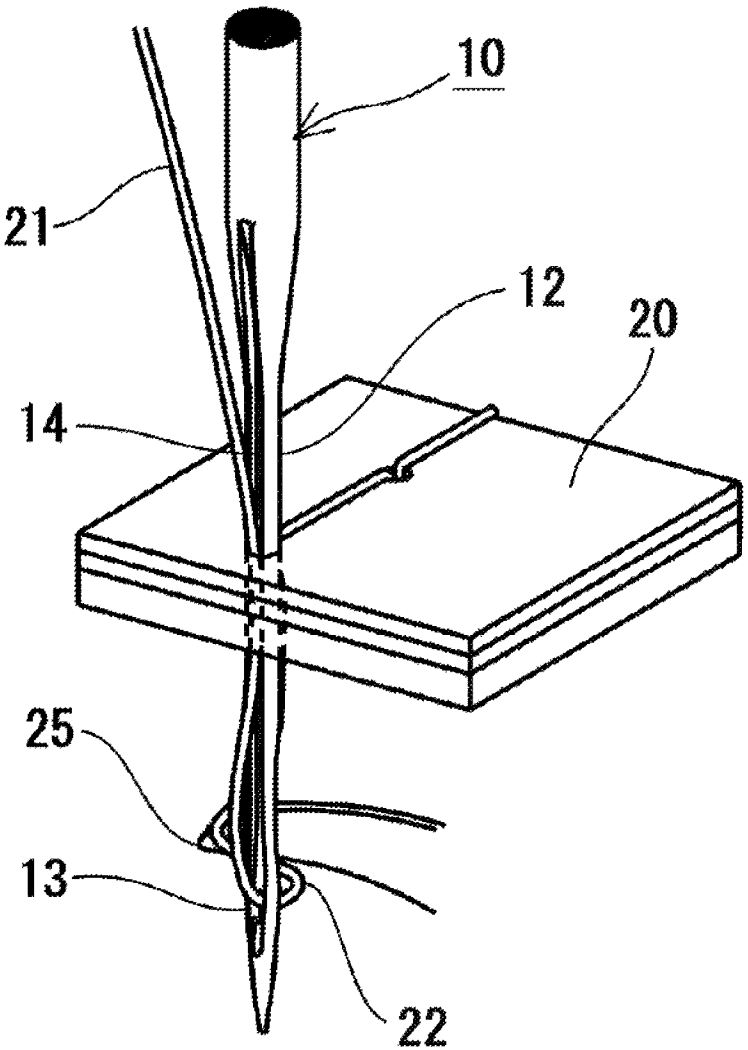

However, assume that a needle thread 21 excellent in smoothness (such as a filament yarn) or a needle thread 21 strong in restoring force (such as a coarse count yarn) is used. In this case, when the sewing machine needle 10 arrives at the bottom dead center, the needle thread 21 may be fed excessively due to the inertia or the restoring force to make the loop 22 too large, as shown in FIG. 9C. When the loop 22 is too large, the loop 22 may collapse to be unable to be successfully caught by the hook 25.

Figure 10:
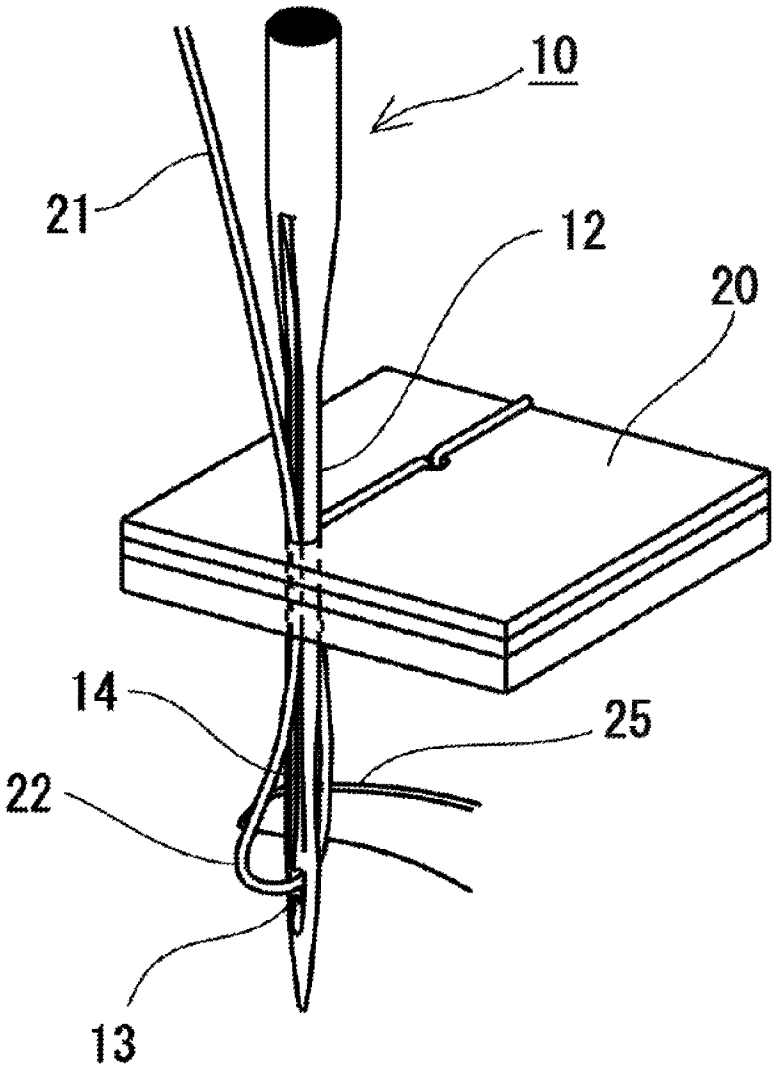
FIG. 10 is a view for explaining a state when the sewing machine needle according to the background art is attached to a sewing machine in use, specifically a situation that a loop of the needle thread is too small to be caught by the hook.

In addition, when the needle thread 21 comes off the long groove 14, as shown in FIG. 10, the loop 22 of the needle thread 21 may bulge out on a front side (an opposite side to the hook 25) so that the loop 22 on the hook 25 side cannot be formed sufficiently. When the loop 22 on the hook 25 side cannot be formed into ed sufficiently, the hook 25 cannot go into the loop 22 to thereby fail in catching the loop 22.

Thus, in the sewing machine needle 10 according to the background art, the hook 25 may fail in catching the loop 22 to thereby lead to occurrence of a problem of stitch skipping etc. Incidentally, when a scarf portion 17 of a shaft portion 12 is deepened, a large gap can be provided between the shaft portion 12 and the loop 22. Accordingly, the loop 22 can be easily caught by the hook 25. However, when the scarf portion 17 is deepened, strength of the sewing machine needle 10 is deteriorated. As a result, durability of the sewing machine needle 10 has to be sacrificed.

In this respect, according to the sewing machine needle 10 according to the embodiment, the loop 22 can be easily caught by the hook 25 even when the scarf portion 17 is not deepened.

Figure 3A:
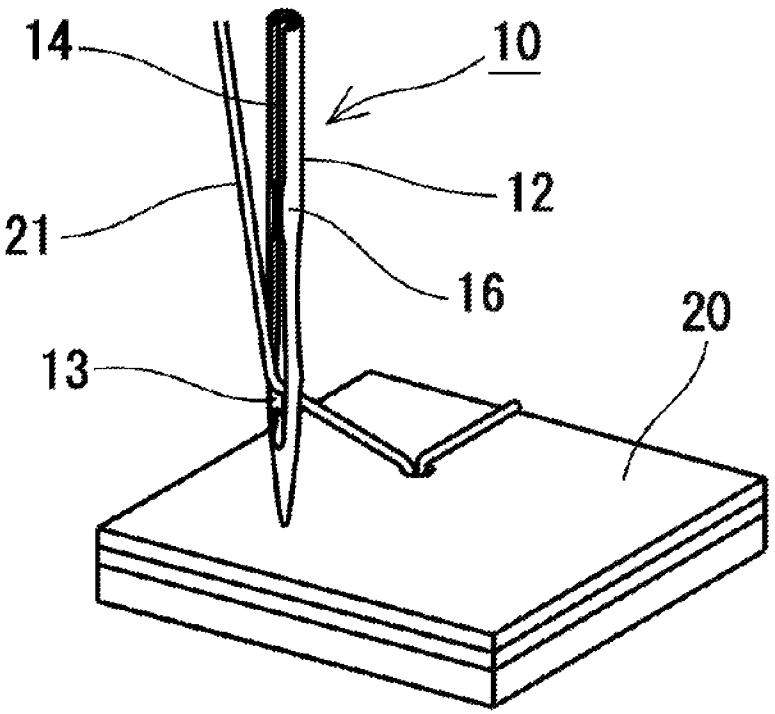
FIGS. 3A to 3C are views for explaining states when the sewing machine needle is attached to a sewing machine in use, FIG. 3A being a view in which the sewing machine needle is positioned on an upper surface of fabric, FIG. 3B being a view in which the sewing machine needle is positioned at a bottom dead center, FIG. 3C being a view in which a hook catches a needle thread.
Figure 3B:
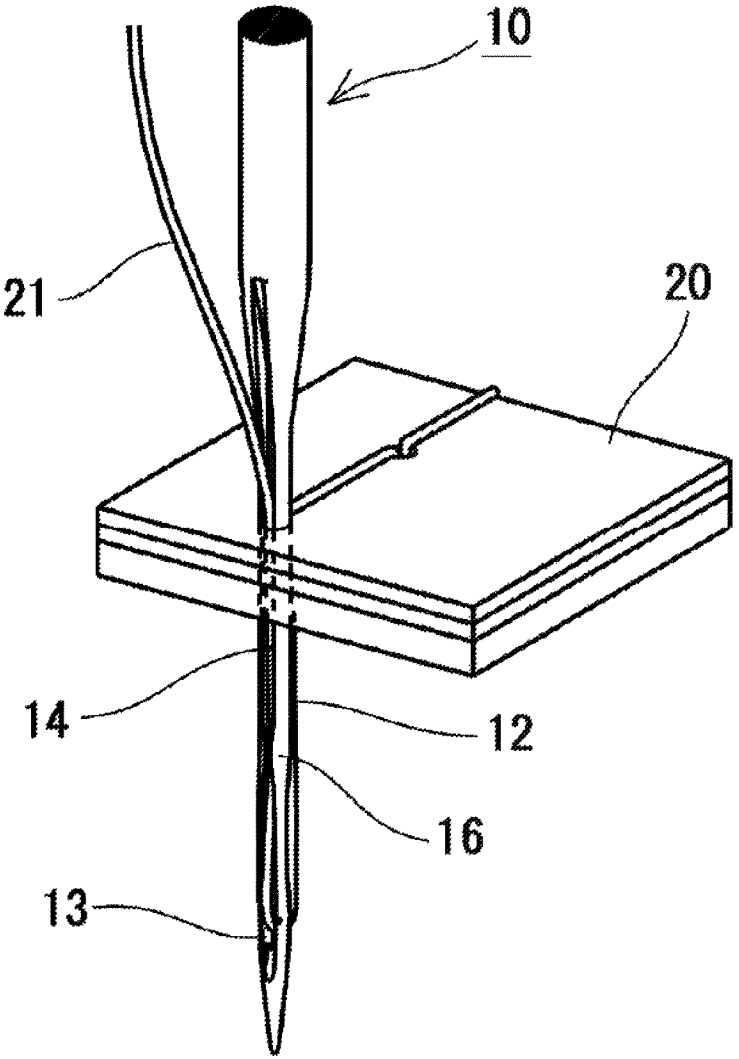

That is, the sewing machine needle 10 according to the embodiment is the same as that according to the background art at the point that the needle thread 21 that has been run through the needle eye 13 is laid along the long groove 14 to be opposed thereto, as shown in FIG. 3A. When the sewing machine needle 10 penetrates the fabric 20 serving as the object to be sewn in this state, the needle thread 21 goes into the long groove 14 and the needle thread 21 is retained by the suppression portion 16, as shown in FIG. 3B. Since the needle thread 21 is retained by the suppression portion 16, movement of the needle thread 21 on the front side of the shaft portion 12 can be suppressed.

Figure 3C:
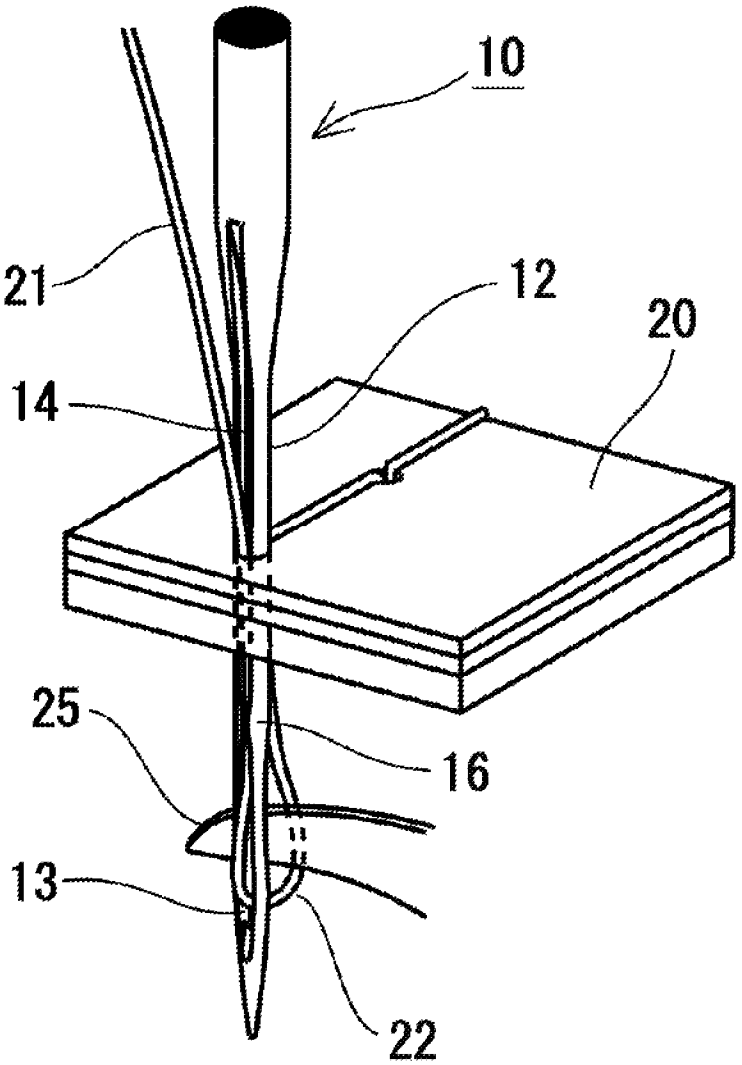

Therefore, when the sewing machine needle 10 has arrived at the bottom dead center, the inertia or the restoring force may still act on the needle thread 21. Even in this case, since the needle thread 21 is retained by the suppression portion 16, the needle thread 21 can be prevented from being fed excessively. In addition, since the needle thread 21 is retained by the suppression portion 16 on the front side (the opposite side to the hook 25), the loop 22 of the needle thread 21 does not bulge out on the front side when the sewing machine needle 10 turns to move up. In other words, the loop 22 can be easily formed on the back side of the sewing machine needle 10, and the loop 22 having an appropriate size can be formed on the hook 25 side. Since the loop 22 having exactly the right size can be formed thus on the back side of the long groove 14, the hook 25 can surely catch the loop 22, as shown in FIG. 3C.

Incidentally, when the sewing machine needle 10 is attached to the sewing machine in use, the entire suppression portion 16 moves to a place under the fabric 20 serving as the object to be sewn, as shown in FIG. 3B. With the configuration made thus, the needle thread 21 can be pushed into the suppression portion 16 by the fabric 20 when the sewing machine needle 10 is passing through the fabric 20. That is, even when the needle thread 21 comes off the suppression portion 16, the needle thread 21 is automatically retained by the suppression portion 16 due to reciprocating motion of the sewing machine needle 10. Accordingly, the suppression portion 16 can be made to act on the needle thread 21 even without providing any special mechanism in the sewing machine etc.

In addition, the suppression portion 16 has a shape in which the width between the opening edges 16*b* is reduced. Accordingly, the needle thread 21 that has been pushed into the suppression portion 16 is covered with the opening edges 16*b* from the opposite sides. Therefore, the suppression portion 16 has a shape in which the needle thread 21 is capped with the opening edges 16*b* so that the needle thread 21 can be prevented from easily coming off the suppression portion 16. In addition, the needle thread 21 is capped with the opening edges 16*b* to be prevented from jumping out of the suppression portion 16. Accordingly, the needle thread 21 can be prevented from easily touching the fabric 20 so that friction between the needle thread 21 and the fabric 20 can be prevented from being easily caused.

According to the embodiment as described above, the needle eye 13 is formed to penetrate the shaft portion 12, the long groove 14 for guiding the needle thread 21 from the position of the needle eye 13 toward the shank portion 11 is formed in the shaft portion 12, and the suppression portion 16 for suppressing movement of the needle thread 21 is provided in the intermediate portion of the long groove 14. According to such a configuration, movement of the needle thread 21 can be suppressed by the suppression portion 16. Thus, a loop 22 can be formed stably.

Moreover, the suppression portion 16 is provided locally in the intermediate portion of the long groove 14. Accordingly, a range where a load is applied to the needle thread 21 can be narrowed so that damage to the needle thread 21 can be minimized. In addition, the range of the suppression portion 16 is narrow. Accordingly, a range in which friction may be caused when the needle thread 21 goes into the suppression portion 16 is also narrow. As a result, the damage to the needle thread 21 can be minimized.

In addition, the machining range for forming the suppression portion 16 is narrow. Accordingly, the sewing machine needle 10 can be also manufactured easily without the necessity of entirely changing the shape of the long groove 14.

In addition, the suppression portion 16 is shaped like the dovetail groove in which the width between the opening edges 16*b* is reduced in the long groove 14. According to such a configuration, the needle thread 21 can be prevented from easily coming off the suppression portion 16. Thus, the needle thread 21 can be surely retained. In addition, the needle thread 21 retained by the suppression portion 16 can be prevented from easily touching the fabric 20. Accordingly, friction between the fabric 20 and the needle thread 21 can be prevented from being easily caused. That is, damage received by the needle thread 21 can be suppressed.

In addition, when the sewing machine needle 10 is attached to the sewing machine in use, the entire suppression portion 16 moves to a place under the fabric 20 serving as the object to be sewn. According to such a configuration, the needle thread 21 can be retained in the vicinity of the needle eye 13. Accordingly, formation of the loop 22 on the suppression portion 16 side can be suppressed so that the loop 22 can be formed stably on the back side.

In addition, when the sewing machine needle 10 is passing through the fabric 20, the needle thread 21 is pushed into the suppression portion 16 by the fabric 20. Accordingly, the needle thread 21 can be surely retained by the suppression portion 16.

Incidentally, the position of the suppression portion 16 can be set desirably at any place where the suppression portion 16 can move to a point under the fabric 20. For example, types of sewing machine needles 10 having a variety of positions as to the position of the suppression portion 16 may be manufactured correspondingly to kinds of threads to be used. In addition, when each of such types of sewing machine needles 10 is manufactured, the suppression portion 16 may be formed by pressing. That is, first, each of the types of the sewing machine needles 10 is manufactured so that a long groove 14 is formed to be parallel with a suppression portion 16 that has not been formed yet. Then, an intermediate portion of the long groove 14 is pressed to thereby form the suppression portion 16. In this manner, a plurality of types of sewing machine needles 10 having a variety of positions as to the position of the suppression portion 16 can be manufactured by changing only the pressing step.

Figure 4A:
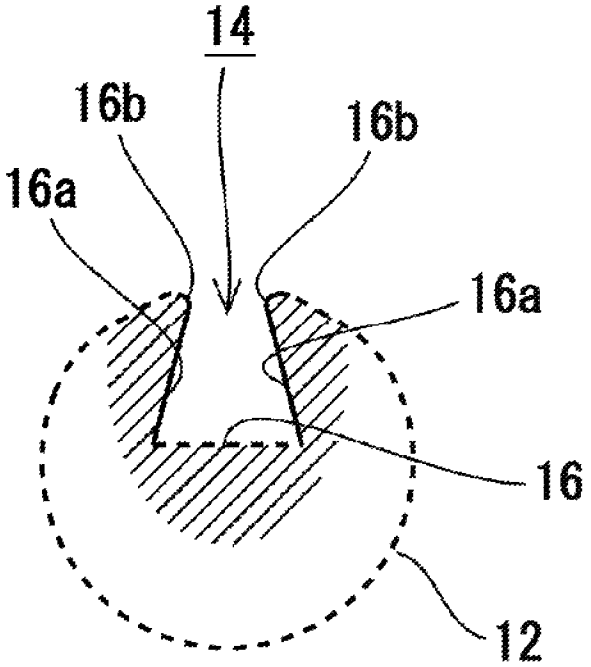
FIGS. 4A to 4D are sectional views of the sewing machine needle in a suppression portion, FIG. 4A being a view according to a first embodiment, FIG. 4B being a view according to Modification 1, FIG. 4C being a view according to Modification 2, FIG. 4D being a view according to Modification 3.

Incidentally, the suppression portion 16 according to the aforementioned embodiment is formed in such a manner that the inner side surfaces 16*a* of the suppression portion 16 slant linearly gradually, as shown in FIG. 4A. However, the suppression portion 16 is not limited thereto.

Figure 4B:
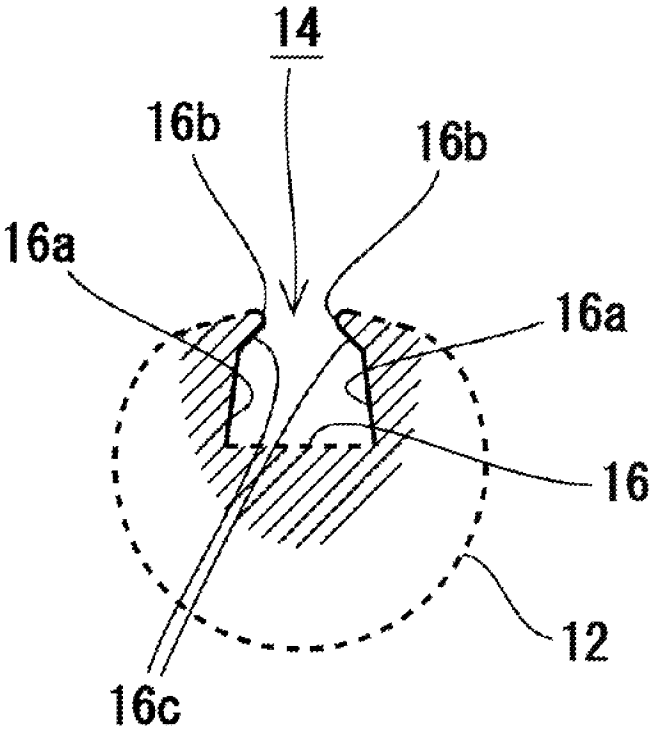

For example, as shown in FIG. 4B, an inclination angle of each of inner side surfaces 16*a* of a suppression portion 16 may be changed stepwise so that the suppression portion 16 can be formed into a shape in which the width between opening edges 16*b* is reduced. Specifically, protruding portions 16*c* between which an opening is made suddenly narrower than that between the inner side surfaces 16*a* of the suppression portion 16 may be provided, so that the inner side surfaces 16*a* of the suppression portion 16 can slant gradually and approach suddenly inward at the opening edges 16*b*.

Figure 4C:
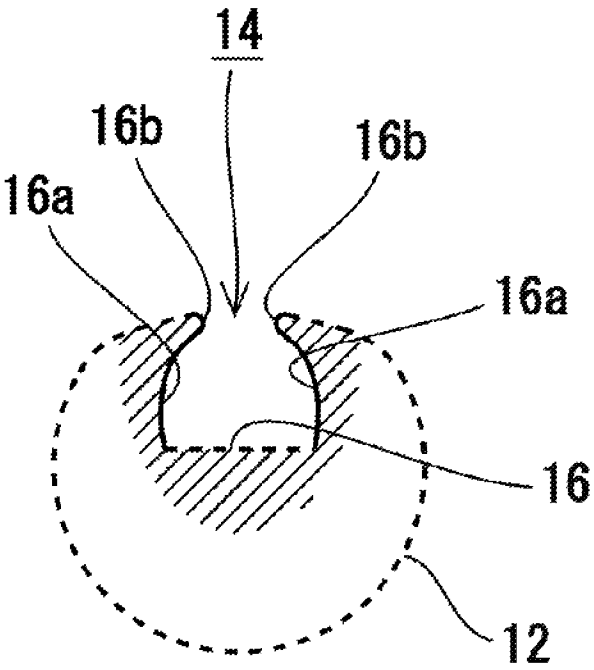

In addition, as shown in FIG. 4C, a suppression portion 16 may be formed in such a manner that inner side surfaces 16*a* of the suppression portion 16 can slant curvedly gradually. Specifically, the suppression portion 16 may be formed into a dovetail groove shape in which the inner side surfaces 16*a* of the suppression portion 16 bulge curvedly outward and the width between opening edges 16*b* is reduced in a long groove 14 due to the side surfaces 16*a*.

Figure 4D:
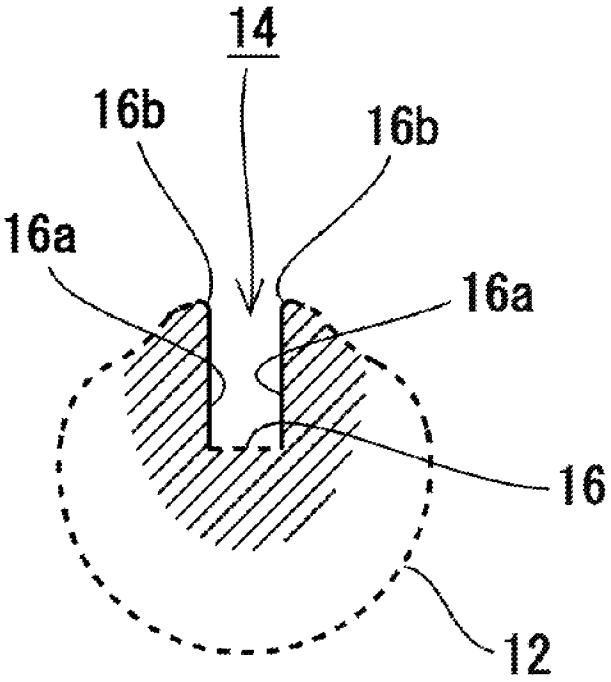

In addition, as shown in FIG. 4D, inner side surfaces 16*a* of a suppression portion 16 may be provided in parallel with each other. However, the width of the suppression portion 16 (distance between the opposite side surfaces 16*a*) is set to be smaller than the width of each of parallel portions 15 (the distance between opposite side surfaces 15*a*). Thus, a sectional area of a groove in the suppression portion 16 is formed to be smaller than the sectional area of the groove in the parallel portion 15.

Incidentally, in the aforementioned embodiment, the scarf portion 17 comparatively deep is provided on the back side of the shaft portion 12. However, according to the sewing machine needle 10 according to the embodiment, the loop 22 is easily caught by the hook 25 even when the scarf portion 17 is not deepened. Accordingly, the sewing machine needle 10 according to the embodiment may have any of forms shown in FIGS. 5A and 5B, FIGS. 6A and 6B, and FIGS. 7A and 7B.

Figure 5A:
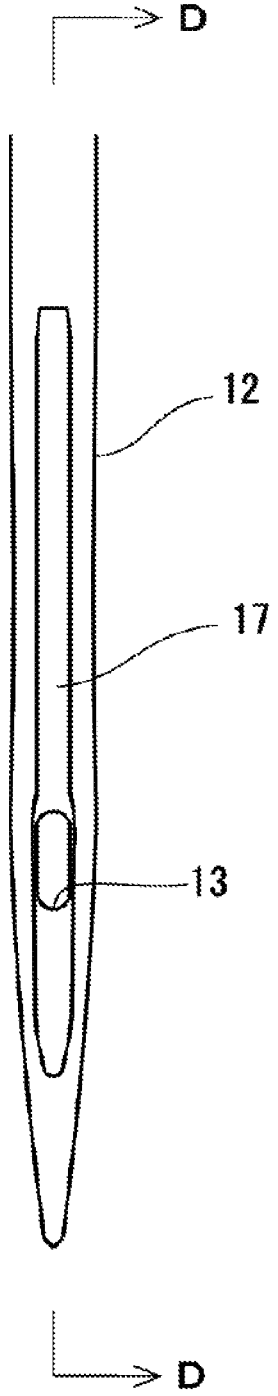
FIGS. 5A and 5B are a back view of the vicinity of a needle point of a sewing machine needle according to Modification 4 in an enlarged manner, and a sectional view taken along a line D-D of FIG. 5A.
Figure 5B:
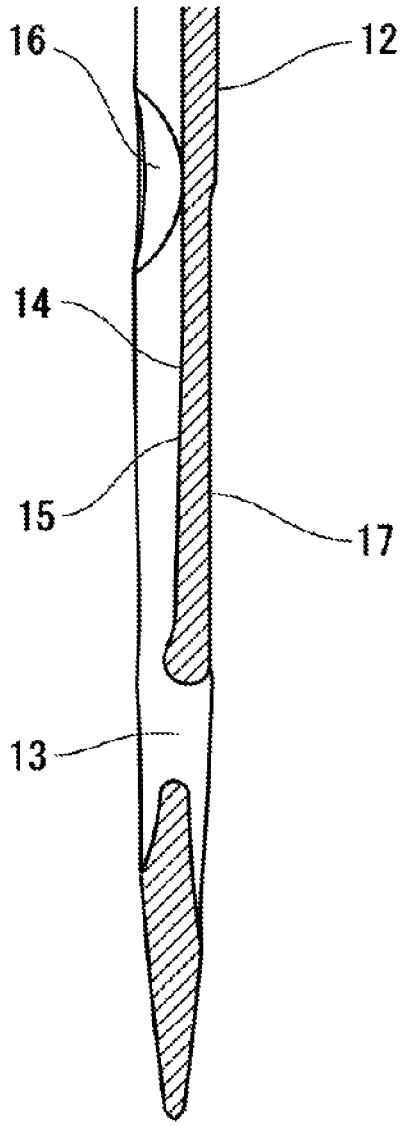

That is, in the example shown in FIGS. 5A and 5B, a very shallow scarf portion 17 is provided. The scarf portion 17 is formed to be narrower than the width of a needle eye 13. Even when such a shallow scarf portion 17 is provided, a loop 22 can be surely formed. Accordingly, the loop 22 can be caught by a hook 25. Since the scarf portion 17 is made shallow, strength of the sewing machine needle 10 can be improved.

Figure 6A:
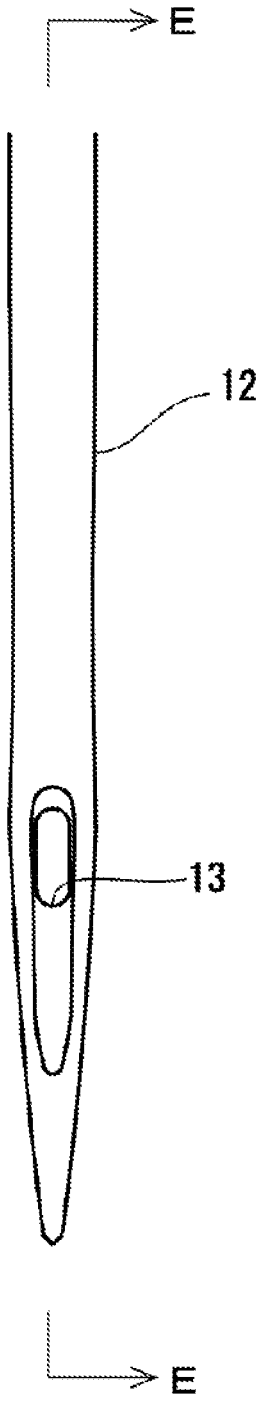
FIGS. 6A and 6B are a back view of the vicinity of a needle point of a sewing machine needle according to Modification 5 in an enlarged manner, and a sectional view taken along a line E-E of FIG. 6A.
Figure 6B:
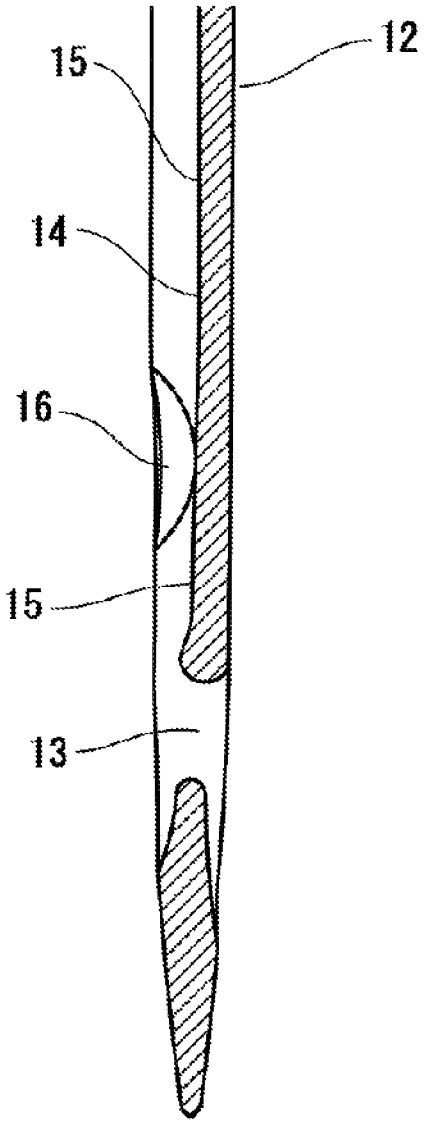

In addition, in the example shown in FIGS. 6A and 6B, no scarf portion 17 is provided. Even when no scarf portion 17 is provided thus, a loop 22 can be surely formed. Accordingly, the loop 22 can be caught by a hook 25. Since no scarf portion 17 is provided, strength of the sewing machine needle 10 can be improved.

Figure 7A:
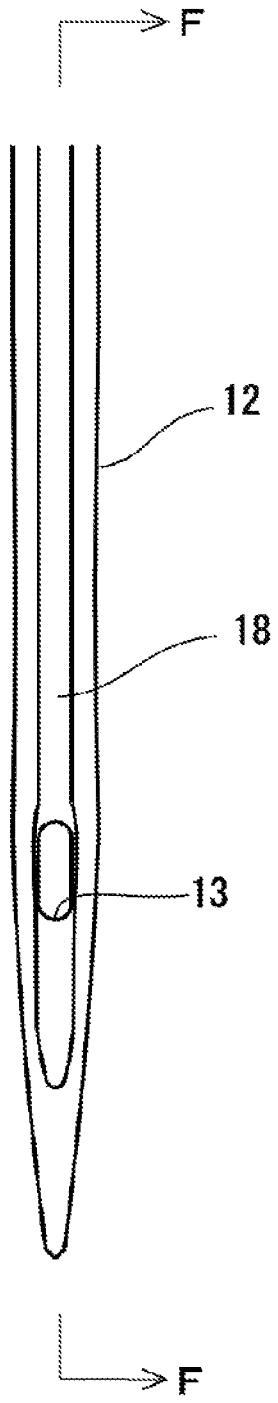
FIGS. 7A and 7B are a back view of the vicinity of a needle point of a sewing machine needle according to Modification 6 in an enlarged manner, and a sectional view taken along a line F-F of FIG. 7A.
Figure 7B:
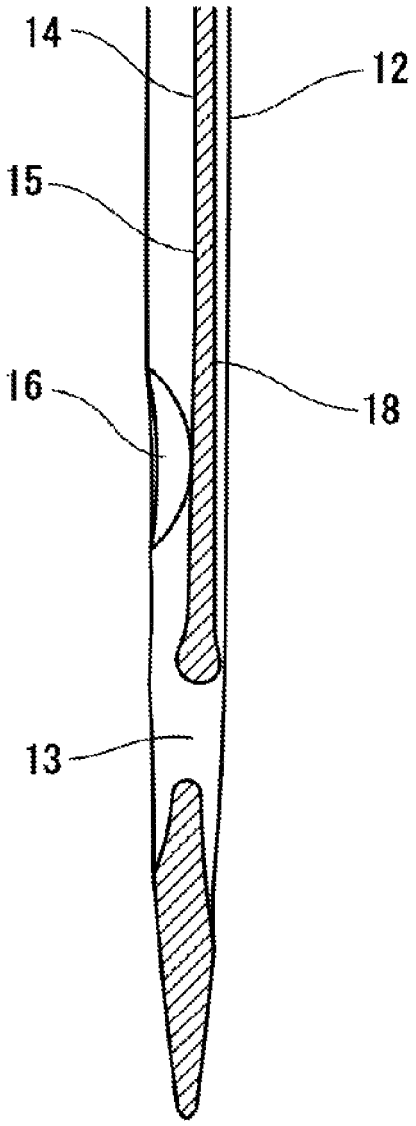

In addition, in the example shown in FIGS. 7A and 7B, a back groove 18 is provided in place of the scarf portion 17. The back groove 18 is formed to recess a back side of a shaft portion 12, and formed to be narrower than the width of a needle eye 13. Even when the back groove 18 is provided thus, a loop 22 can be surely formed. Accordingly, the loop 22 can be caught by a hook 25. In addition, the width of the back groove 18 is narrow. Accordingly, strength of the sewing machine needle 10 can be improved.

Figure 8A:
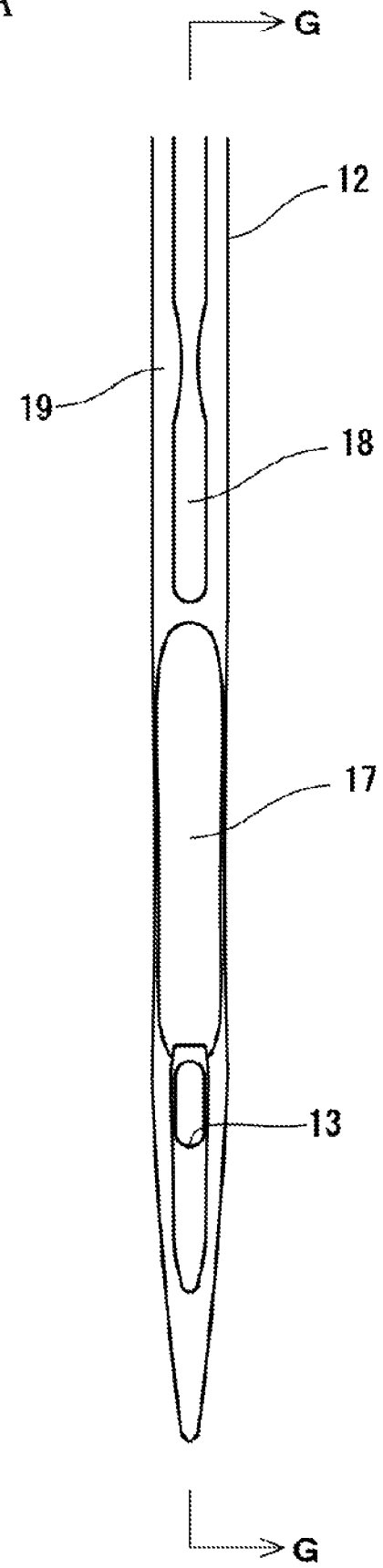
FIGS. 8A and 8B are a back view of the vicinity of a needle point of a sewing machine needle according to Modification 7 in an enlarged manner, and a sectional view taken along a line G-G of FIG. 8A.
Figure 8B:
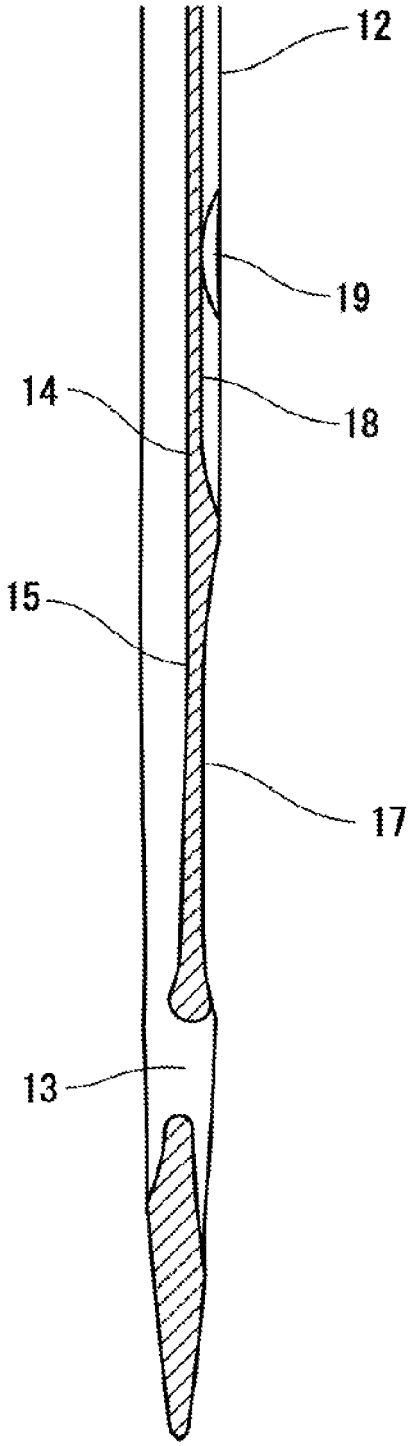

In addition, in order to adjust an inflow amount of a needle thread 21 or reduce any damage to the needle thread 21, a suppression portion 19 may be provided in a back groove 18, as shown in FIGS. 8A and 8B. The suppression portion 19 of the back groove 18 may be configured in a similar manner to or the same manner as the suppression portion 16 according to the aforementioned embodiment. Incidentally, in the example shown in FIGS. 8A and 8B, a scarf portion 17 is provided between a needle eye 13 and the back groove 18. When the suppression portion 19 is provided in the back groove 18 thus, the thread can be easily drawn from a previous stitch. Accordingly, the sewing machine needle 10 can exert an effect of tightening stitches.

What is claimed is:

1. A sewing machine needle comprising:

a shank portion that is attached to a sewing machine; and a shaft portion that is provided on a front end side of the shank portion; wherein:

a needle eye is formed to penetrate the shaft portion, and a long groove for guiding a thread from a position of the needle eye toward the shank portion is formed in the shaft portion;

a suppression portion for suppressing movement of the thread is provided in an intermediate portion of the long groove, and said long groove extends lengthwise along the shaft portion, and the long groove has portions of a wider width than a width of said suppression portion on both proximal and distal sides of the suppression portion.

2. A sewing machine needle according to claim 1, wherein:

the suppression portion is formed so that a sectional area of the groove is smaller in the intermediate portion of the long groove.

3. A sewing machine needle according to claim 1, wherein:

the suppression portion is shaped like a dovetail groove in which width between opening edges is reduced in the long groove.

4. A sewing machine needle according to claim 1, wherein:

the suppression portion is provided at a position where the entire suppression portion can move to a place under fabric serving as an object to be sewn when the sewing machine needle is attached to the sewing machine in use.

5. A sewing machine needle according to claim 2, wherein:

the suppression portion is provided at a position where the entire suppression portion can move to a place under fabric serving as an object to be sewn when the sewing machine needle is attached to the sewing machine in use.

6. A sewing machine needle according to claim 3, wherein:

the suppression portion is provided at a position where the entire suppression portion can move to a place under fabric serving as an object to be sewn when the sewing machine needle is attached to the sewing machine in use.

7. A sewing machine needle according to claim 1, wherein:

said long groove extends lengthwise along the shaft portion and said long groove has parallel portions of the same width on both proximal and distal sides of the suppression portion.

8. A sewing machine needle according to claim 1, wherein opposite side surfaces of the suppression portion slant inwards such that an upper end of the suppression portion has a reduced width.

9. A sewing machine needle according to claim 1, wherein a width of the groove is the same at a bottom end of the suppression portion as the width of the long groove on both proximal and distal sides of the suppression portion, but opposite side surfaces of the suppression portion slant inwards such that an upper end of the suppression portion has a reduced width.

10. A sewing machine needle according to claim 1, wherein said suppression portion is a narrow range within an intermediate portion of said long groove.

11. A sewing machine needle according to claim 10, wherein said narrow range not larger than ⅕ as long as the entire long groove.

12. A sewing machine needle according to claim 10, wherein said narrow range not larger than 1/10 as long as the entire long groove.

13. A sewing machine needle according to claim 1, wherein said suppression portion is narrowest at a central region of the suppression portion.

14. A sewing machine needle according to claim 1, wherein opposite edges of said suppression portion form convex surfaces.

* * * * *